US006668154B2

(12) United States Patent
Dickhoff

(10) Patent No.: US 6,668,154 B2
(45) Date of Patent: Dec. 23, 2003

(54) DEVICE FOR CHARGING AND DISCHARGING OF PRINTING MEDIA IN PRINTING PRESSES AND COPIERS

(75) Inventor: Andreas Dickhoff, Kirchheim/Teck (DE)

(73) Assignee: Nexpress Solutions LLC, Rochester, NY (US)

( * ) Notice: Subject to any disclaimer, the term of this patent is extended or adjusted under 35 U.S.C. 154(b) by 61 days.

(21) Appl. No.: 10/126,490

(22) Filed: Apr. 19, 2002

(65) Prior Publication Data

US 2002/0186990 A1 Dec. 12, 2002

(30) Foreign Application Priority Data

May 2, 2001 (DE) ..... 101 24 289

(51) Int. Cl.[7] ..... G03G 15/00

(52) U.S. Cl. ..... 399/388; 399/316; 399/397; 361/213; 361/214; 361/229

(58) Field of Search ..... 399/170, 171, 399/311, 316, 388, 397, 169, 315; 271/208; 361/214, 213, 220, 229

(56) References Cited

U.S. PATENT DOCUMENTS

| | | | | |
|---|---|---|---|---|
| 2,922,883 A | * | 1/1960 | Giaimo, Jr. | 250/326 |
| 3,620,617 A | * | 11/1971 | Kelly et al. | 399/311 |
| 3,722,992 A | * | 3/1973 | Zweig | 399/147 |
| 4,130,852 A | * | 12/1978 | Peffer et al. | 361/213 |
| 4,542,977 A | * | 9/1985 | Kamogawa et al. | 399/315 |
| 4,563,076 A | | 1/1986 | Takahashi et al. | |
| 4,801,975 A | | 1/1989 | Kano et al. | |
| 4,903,080 A | * | 2/1990 | Taniguchi | 399/315 |
| 4,906,841 A | * | 3/1990 | Taniguchi et al. | 250/324 |
| 4,974,032 A | | 11/1990 | Hara et al. | |
| 5,130,752 A | | 7/1992 | Morishita et al. | |
| 5,132,199 A | | 7/1992 | Takaoka et al. | 430/126 |
| 5,339,144 A | | 8/1994 | Nakai et al. | |
| 5,552,873 A | | 9/1996 | Hirao et al. | |
| 5,581,338 A | | 12/1996 | Nakamichi et al. | |
| 5,596,783 A | * | 1/1997 | Testone | 15/1.51 |
| 5,708,945 A | * | 1/1998 | Kondo | 399/316 |
| 6,032,018 A | * | 2/2000 | Matsumoto et al. | 399/397 |

FOREIGN PATENT DOCUMENTS

| | | | | |
|---|---|---|---|---|
| JP | 04186258 A | * | 7/1992 | G03G/15/02 |
| JP | 08123270 A | * | 5/1996 | G03G/21/06 |

* cited by examiner

*Primary Examiner*—Robert Beatty
(74) *Attorney, Agent, or Firm*—Lawrence P. Kessler

(57) ABSTRACT

A device (2, 3) for charging and/or discharging of printing media (7) in printing presses and copiers, with at least one corona wire (5, 5'), as well as a guiding device (1) for printing media (7) with bridging members (11, 12, 13), which bridge the interior of the discharging device and/or charging device (2, 3) in the transport direction (10), whereby the guiding device (1) has, below the bridging members (11, 12, 13) on the side turned toward at least one corona wire (5, 5'), slim guide fingers (18, 18'), which extend into the border areas (14, 14') of the device (1) parallel to at least one corona wire (5, 5') and from the side outside the surfaces covered by the printing media suppress the thickest ion flow, which is directed to the printing media (7) for discharging of the printing media (7).

15 Claims, 7 Drawing Sheets

DEVICE FOR CHARGING AND DISCHARGING OF PRINTING MEDIA IN PRINTING PRESSES AND COPIERS

FIELD OF THE INVENTION

The invention is related to a device for charging and discharging printing media in printing presses and copiers, particularly of printing media during the passage along the transfer paths of printing presses and copiers.

BACKGROUND OF THE INVENTION

Printing media such as paper sheets, films or the like are electrically discharged during the passage along the transfer paths of printing presses and copiers. In order to prevent the printed paper sheets or film from sticking to one another in the output bin or sticking to sufficiently electrically conductive components on the transfer path, these electrical charges must be discharged. It is known practice to use passive discharging devices such as carbon fiber or stainless steel brushes, or active discharging devices such as corona-discharging devices that are operated by AC high voltage and which have corona wires and/or ionization tips, for this purpose. With such devices, the ions generated by the electric fields between the corona wires or ionization tips and the electrical charges to be discharged are attracted and their effect is offset in this manner. The efficiency of the discharging depends on the environmental conditions.

Such types of discharging devices are known from the U.S. Pat. No. 5,890,046, whereby the high voltage AC field between two corona-discharging devices to each of which a corona wire has been applied and the printing media is passed through between these corona-discharging devices. In the above-mentioned patent, one of the corona-discharging devices is mounted on a rotating distribution roller, whereas the second corona-discharging device is fixed in place.

In the German Published Application DE 34 27 919 A1, a corona-discharging device is illustrated that has a grid-type guide opposite the printing media that is being passed through. However, this grid-type guide concerns an opposite electrode to the inner-lying corona wire. In addition, the electrode, along with a continuous belt conveying the printing media, is passed through the opposite electrode and the corona wire.

The U.S. Pat. No. 5,552,873 shows a guiding device within a combined corona-charging/discharging device, which has bridging members that bridge the interior of the discharging device. The bridging members are arranged in the middle area of the guiding device so that they are spaced further apart from one another than in the areas toward the outside. Furthermore, the bridging members have a different slant with respect to the transport direction of printed material via the discharging device.

The German Patent No. 435686 shows a comparable guiding device combined in corona charging/discharging devices, in which the border of the guiding device is arranged in a manner to prevent a disturbance between the charging device and the discharging device.

The U.S. Pat. No. 5,130,752 shows similar bridging members of a guiding device within a corona-discharging device, which has additional tilts along the standard direction of movement of printing media that are intended to prevent an edge of the printing media from being caught in the path along the bridging members.

One problem with such corona charging/discharging devices is the change of the electrical field between two corona-discharging devices, when printing media or no printing media is found between the corona wires. Likewise, there is a dependency on the electrical resistance of such printing media. In the border area of the gap between the corona wires, in which the passage gap is no longer covered by the printing media, flashovers can occur due to the considerable difference between the electrical resistance and the associated greater electric field strength outside the area covered by the printing media. These types of flashovers generate a disturbing noise for the control and lead to damage of the electronics in the worst-case scenario.

SUMMARY OF THE INVENTION

It is thus the purpose of this invention to provide a device for the charging and discharging of printing media in printing presses and copiers, in which the danger of flashovers is reduced. This is accomplished with the device according to the invention for charging and discharging printing media in printing presses and copiers.

In a particularly advantageous embodiment of the device, the slim bridging members of the guiding device extend at an angle a to the transport direction of the printing media over the entire width of the passage gap. Advantageously, the width of the passage gap basically corresponds to the width B of the largest printing media format, which is discharged in the middle area of the corona-discharging device. In another advantageous embodiment of the device according to the invention, the bridging members and, where necessary, the frames of the guiding device, are composed of an electrical non-conducting material. As a result, the influence of the guiding device on the electrical field between the corona wires is minimized. This supports the slim configuration of the bridging members, which bridge the passage gap and thus covers the smallest surface possible of the passage gap and thus also leads to the smallest distortion possible of the electrical field between the corona wires.

Advantageously, the device is formed in two parts on both sides of the transport path of printing media with at least a first corona wire and a first guiding device on the first side and at least a second corona wire and a second guiding device on the second side.

In another particular embodiment of the device according to the invention, there is a smaller distance between the bridging members of the guiding device at the border of the passage gap than between the bridging members in the middle area of the passage run. In this case, the border of the guiding gap is distinguished in that, for all of the printing formats to be guided, the outside edges of the printing media are located within the border area. The result of the smaller distance between the bridging members is that only a small area of the passage gap is covered, material is saved, and on the other side in the border area, it can be guaranteed with great reliability that if the printing media is dog-eared, such sections are reliably guided through the more closely positioned bridging members from the passage gap into the transfer path.

In another advantageous form of the invention, the bridging members of the guiding device at the border of the passage gap are slanted at a greater angle to the transport direction of the passage gap than in the middle area of the passage gap. As a result, the guiding functions of the bridging members can be advantageously supported. In the border area, the guiding device should, in principle, be reliably guided over the passage gap without creased or bent corners. This functionality increases with increasing angles to the transport direction up to a position of the bridging members in which they are 45° to the transport direction. However, in the middle area, it is the task of the bridging members to reliably guide the leading edges of printing media over the passage gap. This function is improved with smaller angles of the bridging members to the transport direction, since this reduces the probability that an incoming leading edge is caught on a bridging member. Thus, it is an advantage if the tilt of the bridging members increases from the inside to the outside.

In a particularly advantageous further development, the bridging members at the border of the passage gap have an angle of essentially 45° to the transport direction of the printing media. In another advantageous further development, the bridging members in the middle area of the passage gap have an angle of essentially 15° to the transport direction of the printing media. Particularly advantageously, the bridging members between the middle area and the border of the passage gap have an angle between essentially 15° to 45° to the transport direction of the printing media, whereby the angle increases toward the outside.

Advantageously, this type of guiding device is such that the bridging members on the side turned towards the printing media have been rounded off. As a result, the guiding function of the device is supported, since the bearing surface of printing media to the guiding device is reduced. In addition, edges are avoided, since otherwise there is always a possibility that the printing media will be tilted in the transport path.

In another particularly advantageous embodiment of the device according to the invention, the guiding device has entry tilts that are tilted toward the standard direction of movement of the printing media toward the transport direction and incoming printing media tends to be directed toward the middle area of the passage gap. Advantageously, one entry tilt is located at the entrance and the other one at the exit of the passage gap.

In another embodiment of the device according to the invention, the guiding device has one guide finger each in the middle area of the slim side of the guiding device on the side turned toward the printing media. The guide fingers cover the side-by-side corona wires in the border area of the passage gap. As a result, the straight path from one corona wire to another for the corona ions in the border area is interrupted. With the presence of printing media in the middle area of the passage gap, the ion flow in the border area increases, as a result of which the danger of flashovers in this area is increased. Due to the guide fingers, however, the corona ions in this area are to a large extent intercepted, particularly those in the direct connecting line between two corona wires, and thus do not contribute to a further ionization of the air in the border area of the passage gap. As a result, the danger of flashovers is reduced.

In another particularly advantageous further development of the invention is the distance of the ends of the guide fingers from each other and thus the adaptation of the length of the guide fingers to the format of the smallest printing media to be passed through, particularly in such a way that the smallest printing media to be passed through, which runs in the middle through the guiding device, covers the ends of both guide fingers. As a result, by using the smallest format possible, the danger of a flashover is still reduced, and, on the other hand, the covering of the corona wires with printing media of a larger format is minimized in the border area, and thus an optimal discharging of the border area of printing media can also be achieved.

Advantageously, each guide finger of a guiding device according to the invention has an entry tilt, which is slanted in the standard direction of the printing media toward the transport direction. Thus the guiding function of the device according to the invention can be further supported.

In an advantageous embodiment of the invention, the guiding device has devices on the side turned toward the printing media that can be used to attach the guiding device to the discharging device. In this way, the assembly costs are reduced, and other attachment mechanisms are used.

The guiding devices suggested according to the invention for guiding printing media and their components, which are equipped with discharging and charging equipment, may be used in all sheet-processing equipment. Furthermore, a new application is created for all devices that deal with printing media, in which printing media are guided along a transport path.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

The following description according to FIG. 1 through FIG. 7 refers to a preferred embodiment of the device according to the invention described in connection with a discharging device. The content of this description, within the scope of the invention, may easily be transferred to a charging device.

Figure 1:
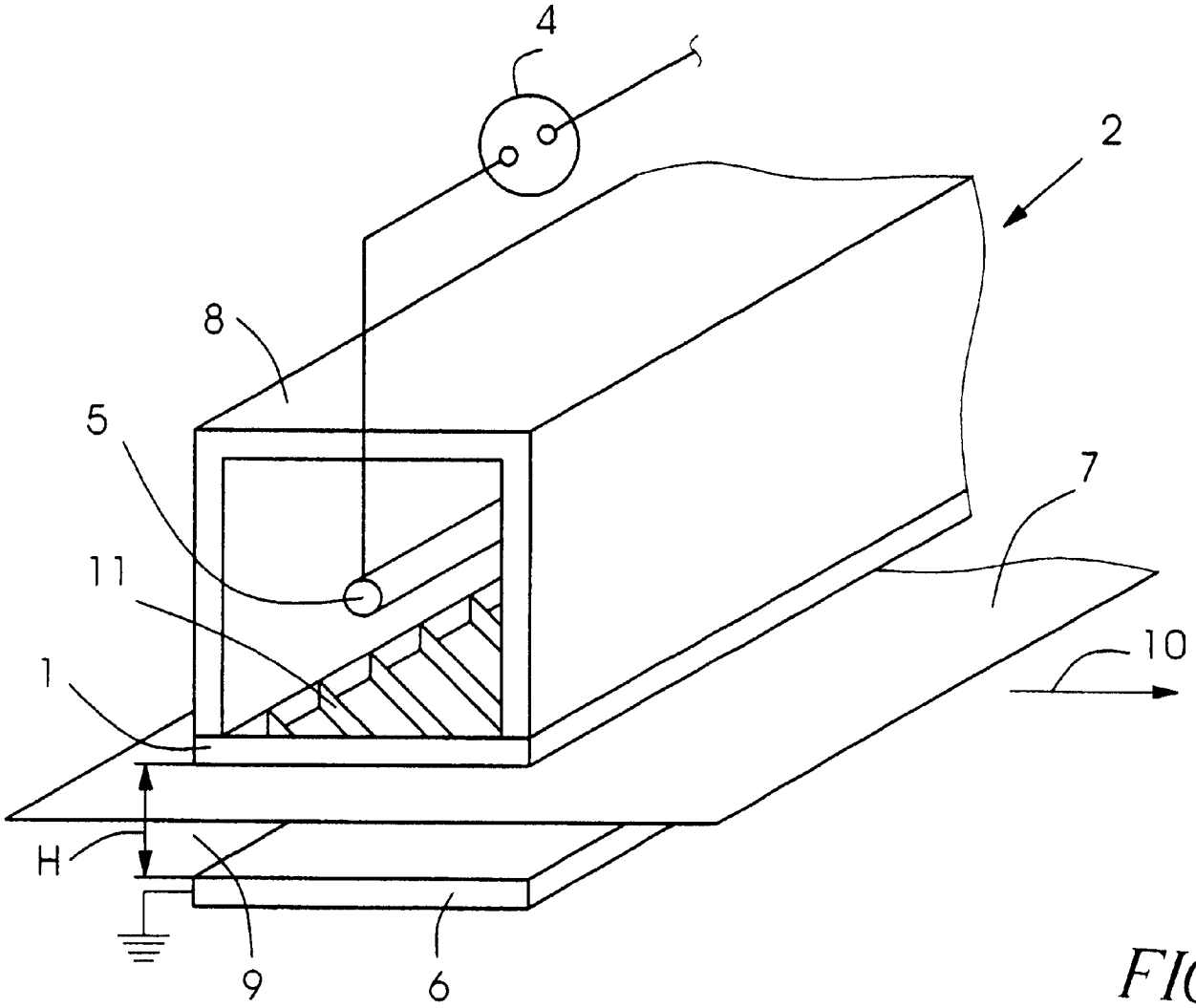
FIG. 1 is a schematic view, in perspective, of the device according to the invention in a configuration with an active discharging device and an opposite electrode.
Figure 2:
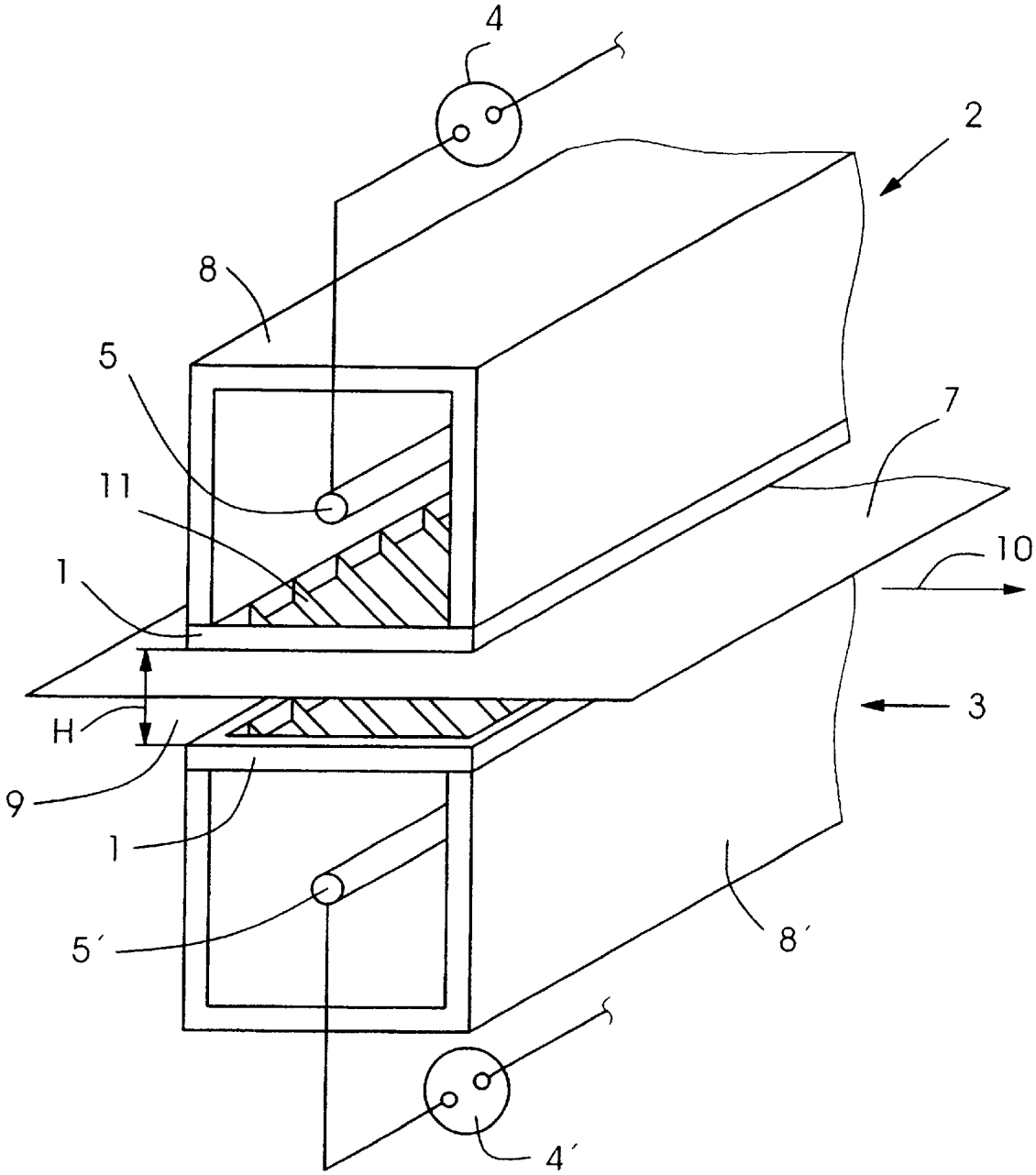
FIG. 2 is a schematic view, in perspective, of the device according to the invention in a version with two active discharging devices.

FIGS. 1 and 2 are schematic drawings of the entire structure of a corona-discharging device 2, 3, of which the description illustrates and explains only the essential components of the invention for the sake of simplicity. Other driving elements or electrical circuits that are generally known and which are required for the operation of the device are only schematically illustrated and are only described in a general form. The corona-discharging device 2, 3 consists essentially of a corona wire 5, 5', which is stretched in a housing 8, 8' and which is connected to a high voltage source 4, 4'. Across from the corona-discharging device 2 as illustrated in FIG. 1, there is an opposite electrode 6, which is typically grounded. When high voltage is applied to the corona wire 5, an electrical field is created between the corona wire 5 and the opposite electrode 6. With sufficient high voltage typically between 3 to 20 kVpp, ions in the air surrounding the corona wire are accelerated by the field prevailing in this area and thus produce further ions, so-called corona ions, which are moved along the field line 20 (see FIG. 7) in the direction of the opposite electrode. Between the corona-discharging device 2, the length L and the width B and the opposite electrode 6, there is a passage gap 9 with a height H, within which the printing media 7 is carried to be discharged by the corona-discharging device 2.

When a printing medium 7 is located between the corona-discharging device 2 and the opposite electrode 6, the field lines 20, which are generated on the printing media by the electrical field, hit the printing medium and go all the way through the printing medium and extend to the opposite electrode 6. The same applies to the field pattern with a dual corona-discharging device 2, 3, in which the field lines accordingly continue up to the opposite corona wire 5. The corona ions generated by the corona wire 5, 5' are accordingly accelerated along the field lines 20 and strike the printing medium 7, whereby they discharge the printing medium 7.

Figure 4:
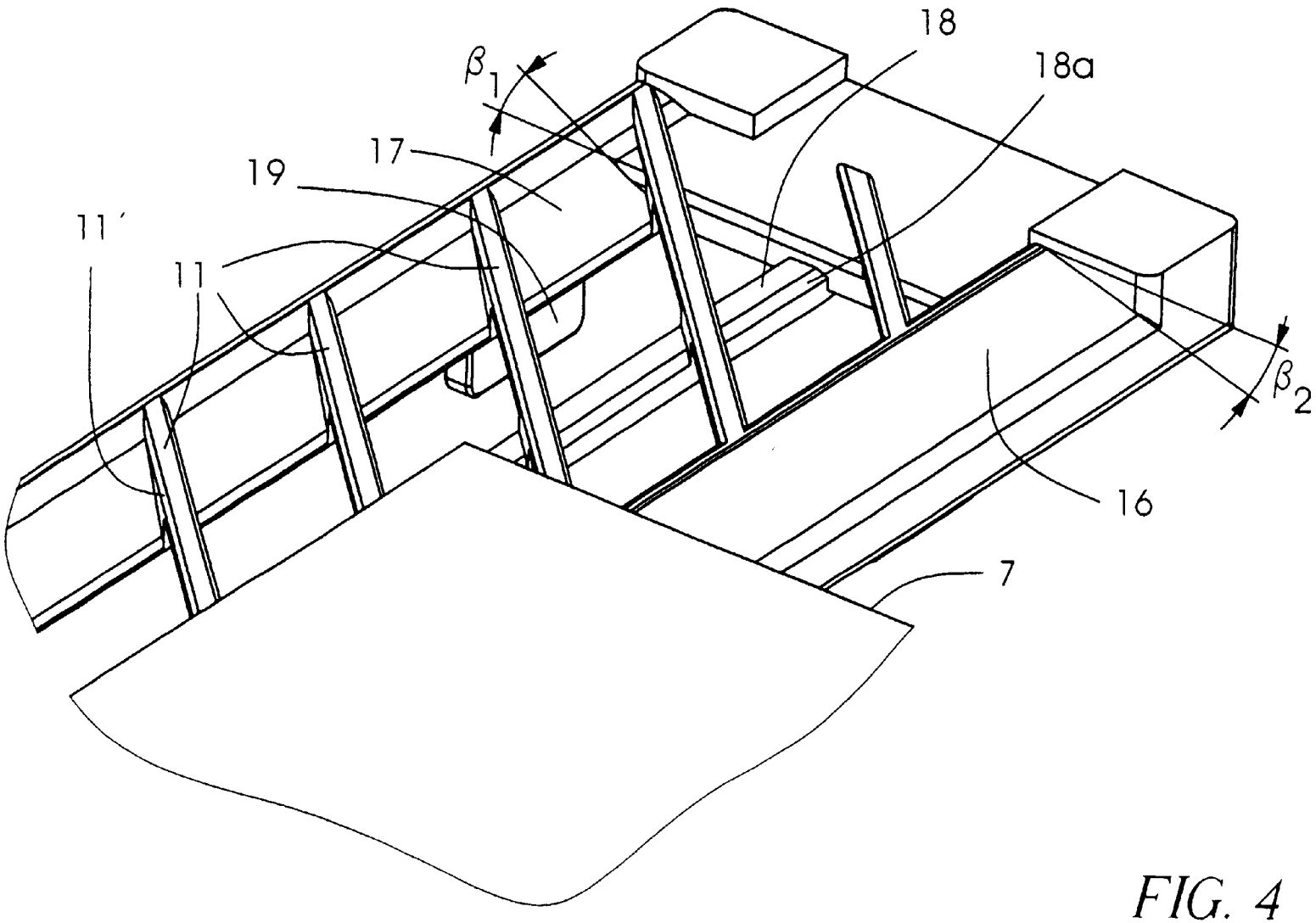
FIG. 4 is an enlarged view of a portion of the device according to the invention in the border area with tilts.
Figure 6:
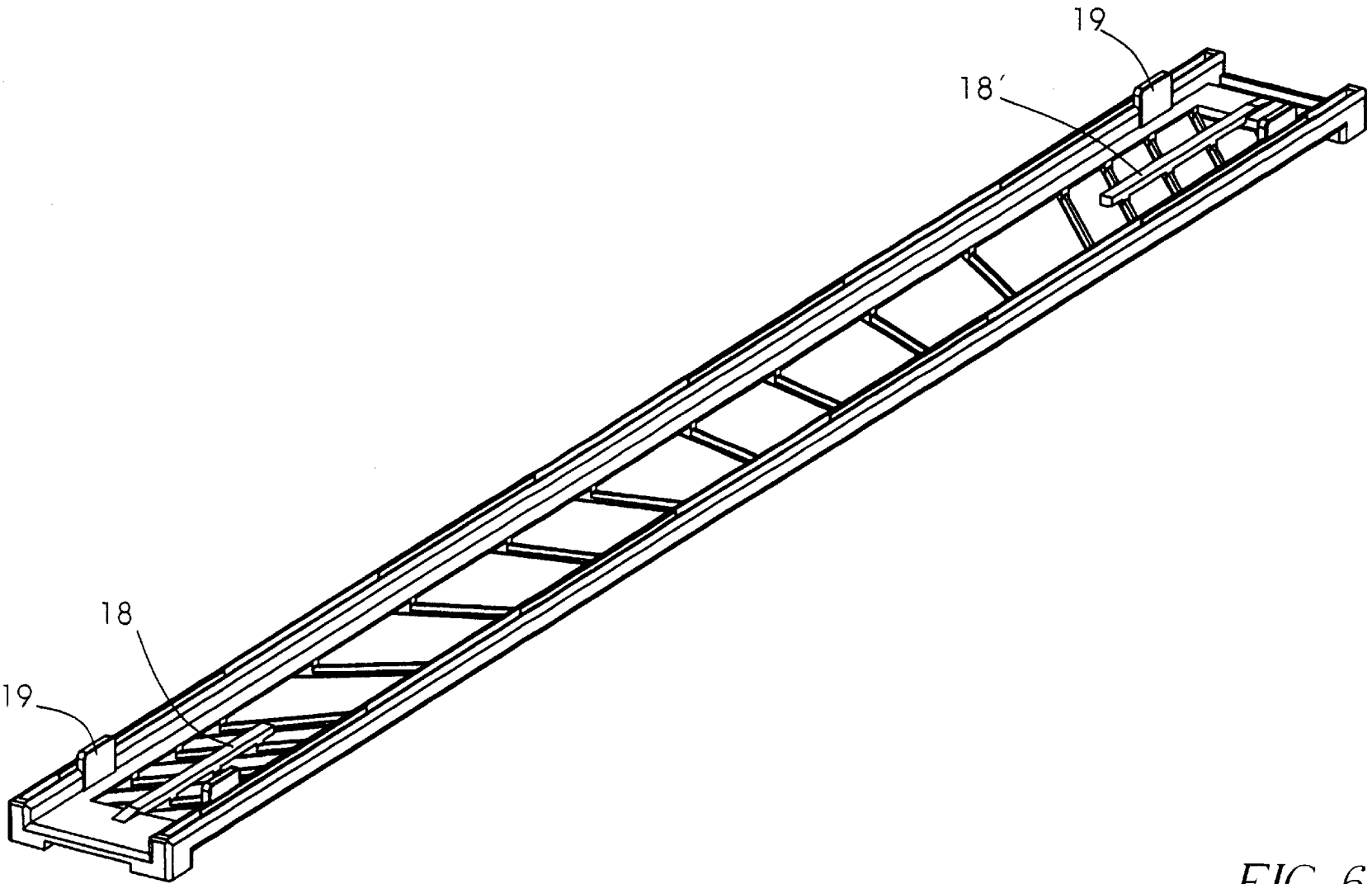
FIG. 6 is a schematic view, in perspective, of the device according to the invention viewed toward the side turned away from the printing media with guide fingers.

The guiding device 1 according to the invention is attached between the actual corona-discharging device 2, 3 and the printing media 7 on the corresponding corona-discharging device 2, 3. For this purpose, the noses 19 illustrated in FIG. 4 and FIG. 6 are used, which may be inserted in the housing 8 of the respective corona-discharging device 2, 3. The expert working in this field knows that all other known state-of-the-art mechanisms and/or operating connections for the detachable or fixed attachment of a plastic component may also be applied to another object, i.e. the guiding device 1 with the frame of the discharging device 8.

Figure 3:
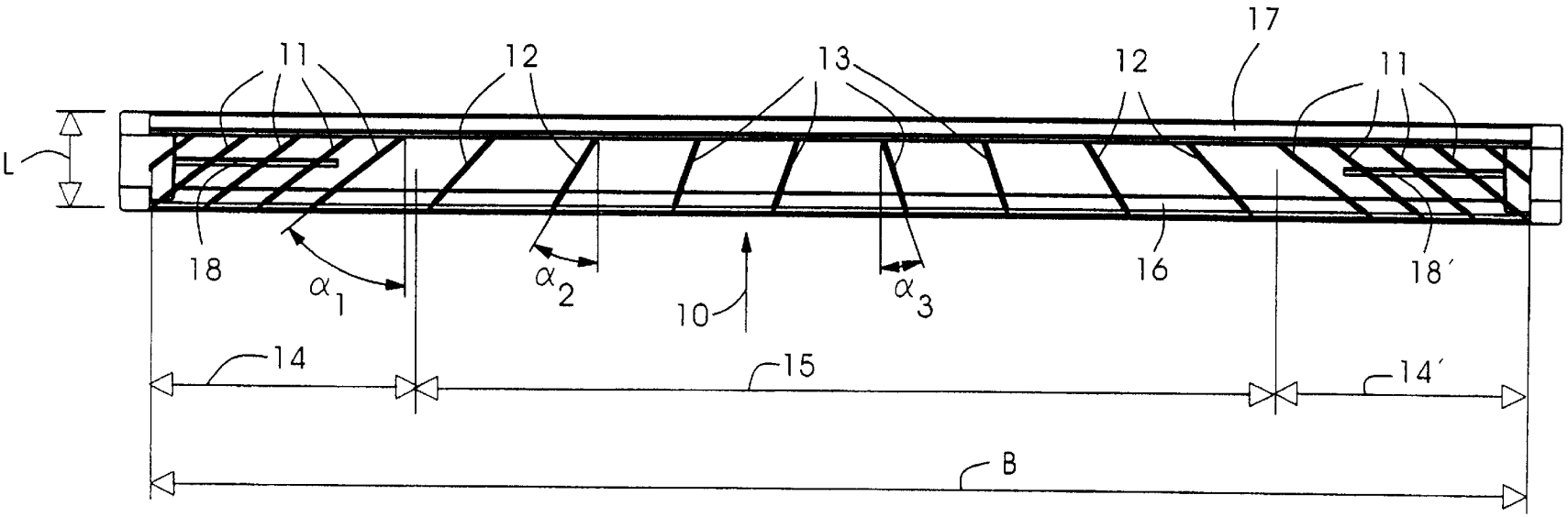
FIG. 3 is a schematic top view of the device according to the invention with a subdivided border area and middle area.

A guiding device 1 is illustrated in the top view in FIG. 3. Within the frame, a number of slim bridging members 11, 12, 13 are located, which basically connect the frame to the transport direction identified with the reference number 10, and thus bridge the passage gap 9 of the corona-discharging device 2, 3. The transport direction 10 thus provides the direction in which the printing media 7 to be discharged passes the corona-discharging device 2, 3.

The guiding device 1 is basically divided in three areas along the width B of the guiding device 1: two border areas 14, 14' and a middle area 15. The middle area 15 is completely covered by each printing medium 7 that always passes through the middle within the bounds of the inherent tolerances of a conveying device of printing media 7.

In the border areas, the outer edges of the printing media 7 advance, either inside or outside, depending on the format of the printing media 7. The entire width B of the passage gap 9 is the upper limit for the applicable forms of printing media 7, which may be discharged by the discharging device 2, 3. Within the border areas 14, 14', the bridging members 11 have a smaller distance between them than the bridging members 12, 13 do in the middle area 15.

With the exemplary embodiment of the device according to the invention shown herein, there are 16 bridging members 11, 12, 13 on each guiding device 1. The eight bridging members 11, which bridge the passage gap of the discharging device, have a greater angle $\alpha_1$ to the transport direction 10 in the border area 14, 14' than the angles $\alpha_2$, $\alpha_3$ of the eight bridging members 12, 13 in the middle area 15 of the guiding device 1. Within the middle area 15, the angles $\alpha_2$, $\alpha_3$ of the bridging members 12, 13 to the transport direction 10 decrease toward the middle area.

In the embodiment illustrated herein, the bridging members 11 take on a value of 45° in the border areas 14, 14' for the angle $\alpha_1$ between the bridging members 11 and the transport direction 10. In the middle area, the bridging members 12, 13 for the angles $\alpha_2$, $\alpha_3$ between the bridging members 12, 13 and the transport direction 10 take on the values of 30° and 15°, always in pairs of two from the outside toward the inside. The expert working in this field knows that the inventive device may also be equipped with one of 16 different numbers of bridging members and that the angle values of the angles $\alpha_1$, $\alpha_2$, $\alpha_3$ of those used in this embodiment may vary within the scope of the invention.

Figure 5:
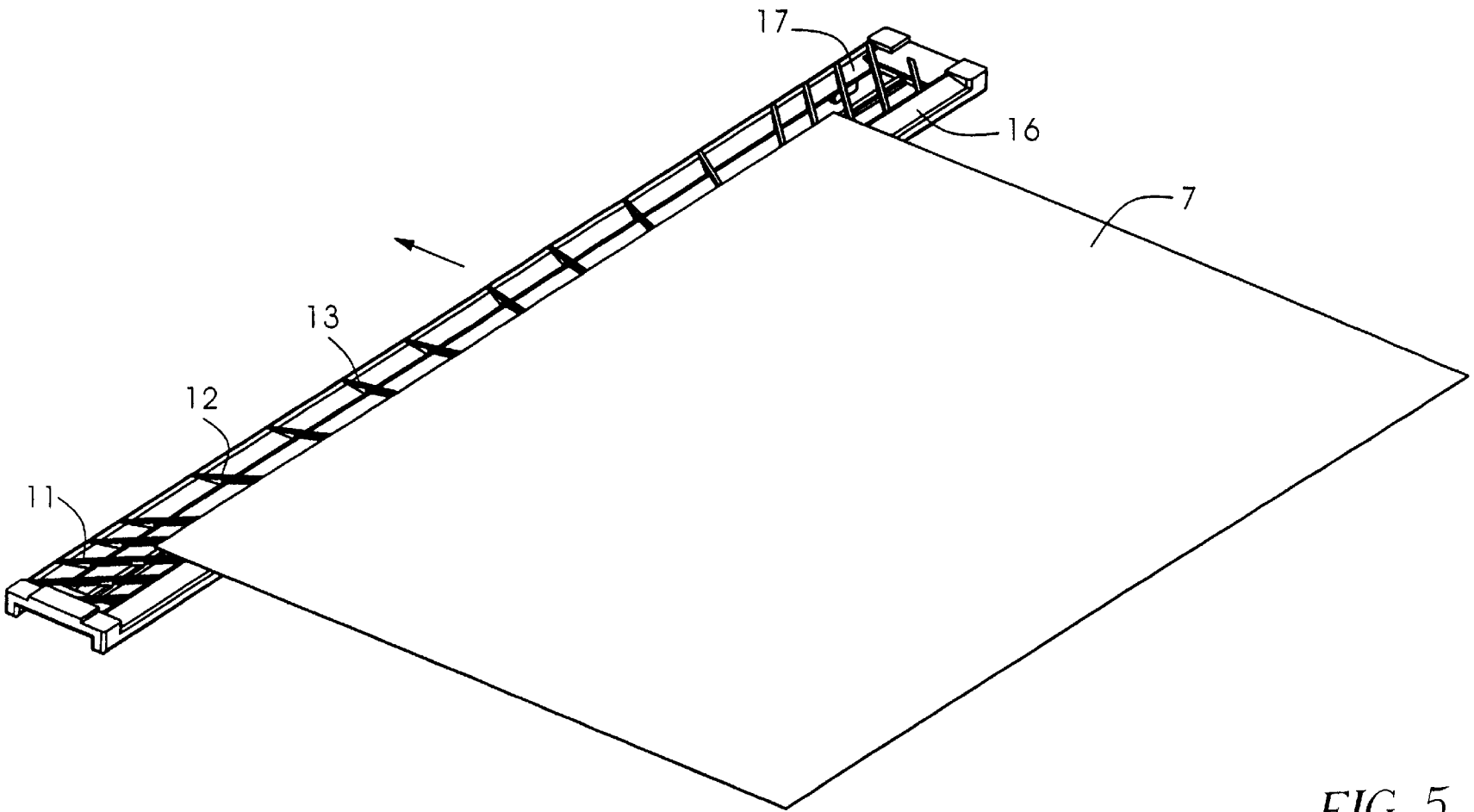
FIG. 5 is a schematic view, in perspective, of the device according to the invention with incoming printing media.

FIG. 4 illustrates a half-tilted side view of the guiding device 1. The guiding effect of the guiding device 1 is supported by an entry tilt 16 and an exit tilt 17, which expands the entry area and exit area of the passage gap, respectively, and which has an aperture angle $\beta_1$ or $\beta_2$ between the transport direction 10, so that the leading edge of incoming printing media 7 is directed into the actual passage gap 9, as illustrated in FIG. 5.

In order to further improve the guiding characteristics of the guiding device 1 and to reduce the damages to the printing media 7, the bridging members 11, 12, 13 on the side turned toward the printing media 7 are rounded off or provided with a chamfered edge 11' (see FIG. 4), so that front sides of printing media 7 passing through are not caught by any unevenness of the bridging members 11, 12, 13.

FIG. 6 illustrates the side of the guiding device 1 that is turned away from printing media 7. Below the bridging members 11, 12, 13, there are two guide fingers 18, 18' in the middle of the longitudinal direction of the guiding device 1. The length of the guide fingers 18, 18' is such that when the smallest format of the printing media 7 of the border of the printing media passes through the middle, the free ends of the guide fingers 18, 18' have chamfered edge **18*a* (see FIG. 4) with an entry tilt 16 and an exit tilt 17, which is comparable to the side lying closer to the incoming printing media 7. In an alternative embodiment, the guide fingers 18, 18' are rounded off instead of having a chamfered edge 18*a***.

Figure 7:
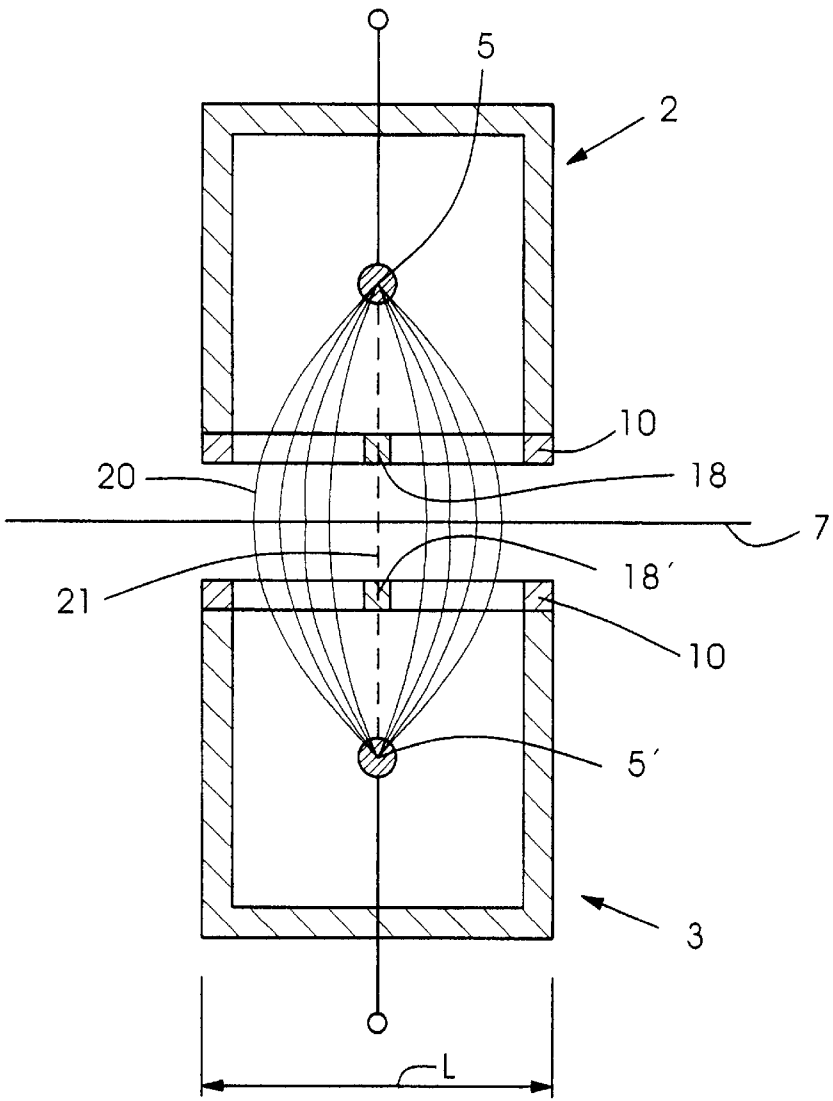
FIG. 7 is a schematic cross-section through the device according to the invention with guide fingers and a dual corona-discharging device.

In FIG. 7, the operating mode of the guide fingers 18, 18' is shown in the cross-section by the passage gap 9 and the discharging devices 2, 3. Field lines 20, 21 are formed between the corona wires 5, 5' and corona ions are accelerated along the field lines 20, 21 when a sufficiently high electrical voltage difference lies at the corona wires 5, 5'. If there is printing media 7 between both discharging devices 2, 3, the corona ions strike the printing media 7. Depending on the field composition, the ion flow decreases, starting from the direct connecting line 21 between both corona wires 5, 5' along the length L of the passage gap 9, and the greatest discharging of printing media 7 but also the greatest ionization of the air thus take place on the direct connecting line 21 in the absence of printing media 7.

In the middle area 15, where the guide fingers 18, 18' do not extend inward (see FIG. 3), the corona ions are only slightly delayed by the slim bridging members 11, 12, 13, so that a smaller portion of the corona ions are not contributed to the discharging of the printing media 7. Due to the advancement of the printing media 7, on the one hand, and to angles $\alpha_1$, $\alpha_2$, $\alpha_3$ between the bridging members 11, 12, 13, and the transport direction 10 on the other hand, the ion flow essentially comes to traverse the connecting line 21 between the corona wires 5, 5' over the entire surface of the printing media 7.

This strong ion flow is not desired outside the printing media, since the resulting considerable ionization of the air can lead to flashovers between the corona wires 5, 5'. This is avoided by the guide fingers 18, 18', which suppress the ion flow on the direct connecting line 21 between the corona wires 5, 5', which results in a considerable reduction in the ionization of the air in the passage gap 9.

The effect described above of the reduction of the ion flow outside the printing media 7 is likewise achieved by a single version of the device 2, 3, in which an opposite electrode 6 is attached opposite the discharging device 2, 3 (see FIG. 1). Here the strongest ion flow is on the standard surface of the opposite electrode 6, which runs through the corona wire 5. In this case, the position of the guide fingers 18, 18' is also on this line of the strongest ion flow.

The described guiding device is manufactured from injection-molded plastic. It should be noted that the guiding device 1 of a first discharging device 2 and the guiding device 1 of a second discharging device 3 concern an identically constructed device, which can avoids a considerable manufacturing cost.

The invention has been described in detail with particular reference to certain preferred embodiments thereof, but it will be understood that variations and modifications can be effected within the spirit and scope of the invention.

PARTS LIST

| | |
|---|---|
| 1 | Guiding device |
| 2, 3 | Corona-discharging device |
| 4 | High voltage source |
| 5, 5' | Corona wire |
| 6 | Opposite electrode |
| 7 | Printing medium, printing media |
| 8, 8 | Housing |
| 9 | Passage gap |
| 10 | Transport direction |
| 11 | Bridging member in the border area |
| 12 | Bridging member in the middle area |
| 13 | Bridging member in the middle area |
| 14 | Border area |
| 15 | Middle area |
| 16 | Entry tilt |
| 17 | Exit tilt |
| 18, 18' | Guide fingers |
| 18a | Chamfered edge |
| 19 | Noses |
| 20 | Field line/Ion path |
| 21 | Field line/Suppressed ion path |
| L | Length of the passage gap |
| B | Width of the passage gap |
| H | Height of the passage gap |
| $\alpha_1$ | Angle between the bridging member and the transport direction in the border area |
| $\alpha_2$, $\alpha_3$ | Angle between the bridging member and the transport direction in the middle area |
| $\beta_1$ | Angle between the entry tilt and the transport direction |
| $\beta_2$ | Angle between the exit tilt and the transport direction |

What is claimed is:

1. Device (2, 3) for discharging and/or charging of printing media (7) in printing presses and copiers, said device comprising: at least one corona wire (5,5'), a guiding device (1) for printing media (7) with bridging members (11, 12, 13) that bridge the interior of the discharging device and/or charging device (2, 3), said guiding device (1) having, below the bridging members (11, 12, 13) on the inward facing side with at least one corona wire (5, 5'), guide fingers (18, 18'), which extend into the border areas (14, 14') of the device (1) parallel to at least one corona wire (5, 5').

2. Device according to claim 1, characterized in that said guide fingers (18, 18') are arranged below said bridging members (11, 12, 13) parallel to the corona wire (5, 5') in such a way that they lie on the intended line (21), which is vertical to said bridging members (11, 12, 13) and which runs through said corona wire (5, 5').

3. Device according to claim 1, characterized in that said device (2, 3) is formed in two parts on both sides of the transport path of a printing media (7) with at least one of said first corona wire (5) and one of said first guiding device (1) on one of the first sides and at least one of a second corona wire (5') and a second guiding device (1) on one of the second sides.

4. Device according to claim 3, characterized in that said guide fingers (18, 18') are arranged below said bridging members (11, 12, 13) to said corona wires (5, 5') in such a way that they lie on the intended connecting line (21) between said first corona wire (5) and said second corona wire (5').

5. Device according to claim 1, characterized in that said guiding device (1) extends over the total width (B) of the passage gap (9) through the discharging device and/or the charging device (2, 3).

6. Device according to claim 1, characterized in that said guiding device (1) consists of an electrically non-conductive material.

7. Device according to claim 1, characterized in that said bridging members (11) of said guiding device (1) in the border area (14, 14') of the passage gap (9) have a smaller distance between them than said bridging members (12, 13) do in the middle area (15) of the passage gap (9) have between them.

8. Device according to claim 1, characterized in that said bridging members (11, 12, 13) along the width (B) of the passage gap (9) have an angle between basically 15° and 45° to the transport direction (10) of the printing media (7), whereby said angle increases toward the outside.

9. Device according to claim 8, characterized in that said bridging members (11) of said guiding device (1) in the border area (14, 14') of the passage gap (9) have an angle of basically 45° to the transport direction (10) of printing media (7).

10. Device according to claim 8, characterized in that said bridging members (13) in the middle area (15) of the passage gap (9) have an angle which is basically 15° to the transport direction of the printing media.

11. Device according to claim 1, characterized in that said bridging members (11, 12, 13) on the side turned toward the printing media (7) are rounded off or chamfered.

12. Device according to claim 1, characterized in that said guiding device (1) has entry tilts (16) and exit tilts (17), which have an angle ($\beta_1$, $\beta_2$) between the transport direction (10) in such a manner that the leading edges of the incoming printing media (7) are guided into the passage gap (9).

13. Device according to claim 1, characterized in that the distance between the ends of said guide fingers (18, 18') has been adapted to the format of the smallest printing media (7) to be passed through in such a way that when the printing media passes through the middle of said guiding device (1), at least both the ends of said guide fingers (18, 18') are covered.

14. Device according to claim 1, characterized in that each of said guide fingers (18, 18') has an inward slanted edge (18*a*).

15. Device according to claim 1, characterized in that said guiding device (1) has noses (19) on the side that is turned away from the printing media (7), which can be used to attach it to the discharging device (2,3).

* * * * *